US009717343B1

(12) United States Patent
Pan

(10) Patent No.: US 9,717,343 B1
(45) Date of Patent: Aug. 1, 2017

(54) CHAIR BACKREST PANEL POSITIONING DEVICE

(71) Applicant: Oasyschair Co., Ltd., Tainan (TW)

(72) Inventor: Toung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 0 days.

(21) Appl. No.: 15/062,254

(22) Filed: Mar. 7, 2016

(51) Int. Cl.
*A47C 7/44* (2006.01)
*F16B 12/10* (2006.01)
*A47C 7/74* (2006.01)

(52) U.S. Cl.
CPC ..... *A47C 7/44* (2013.01); *A47C 7/746* (2013.01); *F16B 12/10* (2013.01); *F16B 2012/106* (2013.01)

(58) Field of Classification Search
CPC ..... A47C 7/44; A47C 7/746; F16B 12/10
USPC ..... 297/230.11, 440.2, 452.13
See application file for complete search history.

(56) References Cited

U.S. PATENT DOCUMENTS 6,257,665 B1 * 7/2001 Nagamitsu ..... A47C 7/405 297/440.2 X
8,297,708 B2 * 10/2012 Mizobata ..... B60N 2/7011 297/230.11
8,998,339 B2 * 4/2015 Peterson ..... A47C 1/024 297/452.13

FOREIGN PATENT DOCUMENTS

JP 2011092475 A * 5/2011 ..... A47C 7/44

* cited by examiner

*Primary Examiner* — Anthony D Barfield
(74) *Attorney, Agent, or Firm* — Alan D. Kamrath; Kamrath IP Lawfirm, P.A.

(57) ABSTRACT

A chair backrest panel positioning device includes a backrest panel frame and a backrest panel. The backrest panel frame has a hollow configuration, is formed along the rear side of the seat of a chair, and has two upper lateral portions configured for retaining predetermined portions of the backrest panel respectively. The backrest panel is separately formed, may or may not conform in shape to the backrest panel frame, and features proper elasticity. The backrest panel frame further has two lateral portions which are at a predetermined height and are configured for clamping the corresponding areas of the backrest panel respectively. Once mounted to the backrest panel frame, the backrest panel can be leaned on elastically.

2 Claims, 7 Drawing Sheets

CHAIR BACKREST PANEL POSITIONING DEVICE

BACKGROUND OF THE INVENTION

1. Technical Field

The present invention relates to a device for positioning the backrest panel of a chair. More particularly, the present invention relates to a chair backrest panel positioning device which includes a backrest panel frame and a separately formed backrest panel of a chair. The backrest panel frame has two predetermined lateral portions for connecting with the backrest panel, so that once mounted to the backrest panel frame, the backrest panel can be leaned on elastically.

2. Description of Related Art

Typically, referring to FIG. 1, a chair 30 includes a backrest 20 of a fixed configuration connected to the rear side of a seat 10, so that one who sits on the chair 30 may lean their back on the backrest 20 while resting their legs comfortably. However, the backrest 20 generally lacks proper elasticity and therefore cannot adapt to the shape of the sitter's back to provide the desired level of comfort when leaned on. To create a more comfortable back-leaning experience, it is not uncommon for the sitter to buy another backrest, which has a suitable curvature, and to tie this additional backrest to the backrest 20 of the chair 30 at a predetermined height.

While this improvised solution does provide the expected comfortableness of contact with the sitter's back, a commercially available backrest does not necessarily conform in width to (i.e., may be too wide or too narrow for) the backrest of the chair in question. To ensure comfortable contact between the backrest of a chair and a sitter's back, the present invention provides a novel chair backrest assembly which features an appropriate width as well as elasticity, so that a user can lean his or her back against the backrest comfortably.

BRIEF SUMMARY OF THE INVENTION

In order for the backrest of a chair to be leaned on comfortably, the present invention provides the following improvement over the prior art: A backrest panel frame for a chair has two upper lateral portions configured to respectively retain the corresponding portions of a separately formed and elastic backrest panel. The backrest panel frame also has two lateral portions which are at a predetermined height and are configured to clamp the corresponding areas of the backrest panel respectively. Once mounted to the backrest panel frame, the backrest panel can be leaned on elastically.

The primary objective of the present invention is to ensure that the backrest of a chair can be leaned on comfortably. To this end, a backrest panel frame having a hollow configuration is formed along the rear side of the seat of a chair. The backrest panel frame has two upper lateral portions configured to retain predetermined portions of a backrest panel respectively. The backrest panel is separately formed, may or may not conform in shape to the backrest panel frame, and has proper elasticity. The backrest panel frame further has two lateral portions which are at a predetermined height and are configured to clamp the corresponding areas of the backrest panel respectively. Thus, the backrest panel can be leaned on elastically after it is mounted to the backrest panel frame.

The second objective of the present invention is to ensure that the backrest panel frame retains the backrest panel properly. To this end, the two upper lateral portions of the backrest panel frame are each extended with a pin. The two pins face each other and each have a predetermined section concavely formed with an annular groove. The rear side of the backrest panel has two predetermined sections each formed with a hook. The hooks open downward and are engaged with the pins respectively. The inner side of each hook has a predetermined area protrudingly provided with a curved projection, and each curved projection is engaged with the annular groove of the corresponding pin of the backrest panel frame. In addition, the front side of the backrest panel has two apertures corresponding in position to and extending from the hooks respectively, and at least one tube extends from a predetermined portion of each hook. Two limiting members conform in shape to the apertures respectively, and each has one end extended with a pressing flange. Each pressing flange is inserted through the corresponding aperture of the backrest panel and is engaged with the annular groove of the corresponding pin of the backrest panel frame. A plurality of threaded fasteners is passed through holes in predetermined sides of the limiting members respectively and is fastened in the tubes of the backrest panel respectively. Thus, the predetermined portions of the backrest panel are respectively and securely retained by the two upper lateral portions of the backrest panel frame.

The third objective of the present invention is to allow ventilation of the backrest panel when the backrest panel is leaned on. To this end, at least one hollow slot is provided in the backrest panel, which is retained by the backrest panel frame. The at least one hollow slot may or may not be arranged at a predetermined spacing.

DETAILED DESCRIPTION OF THE INVENTION

Figure 1:
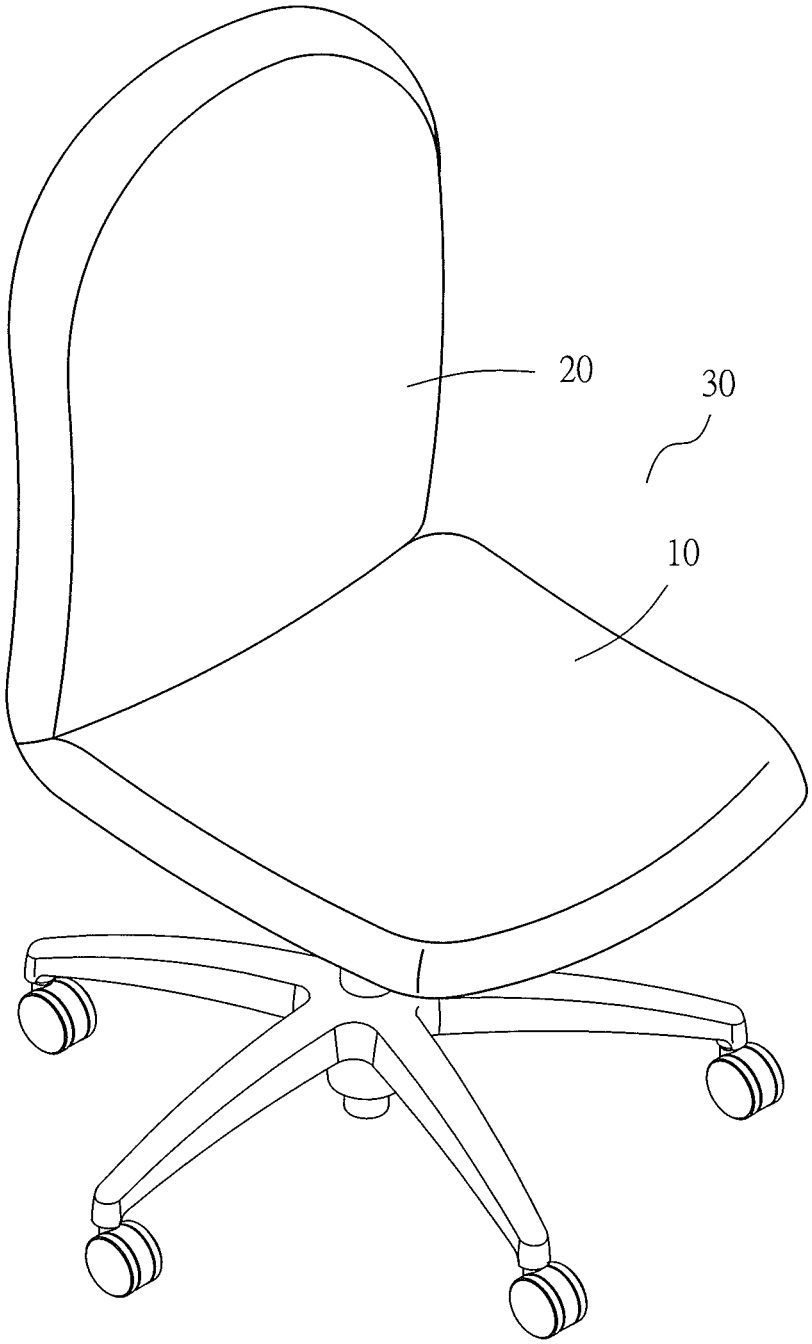
FIG. 1 (Prior Art)
FIG. 1 schematically shows the backrest panel of a conventional chair.
Figure 2:
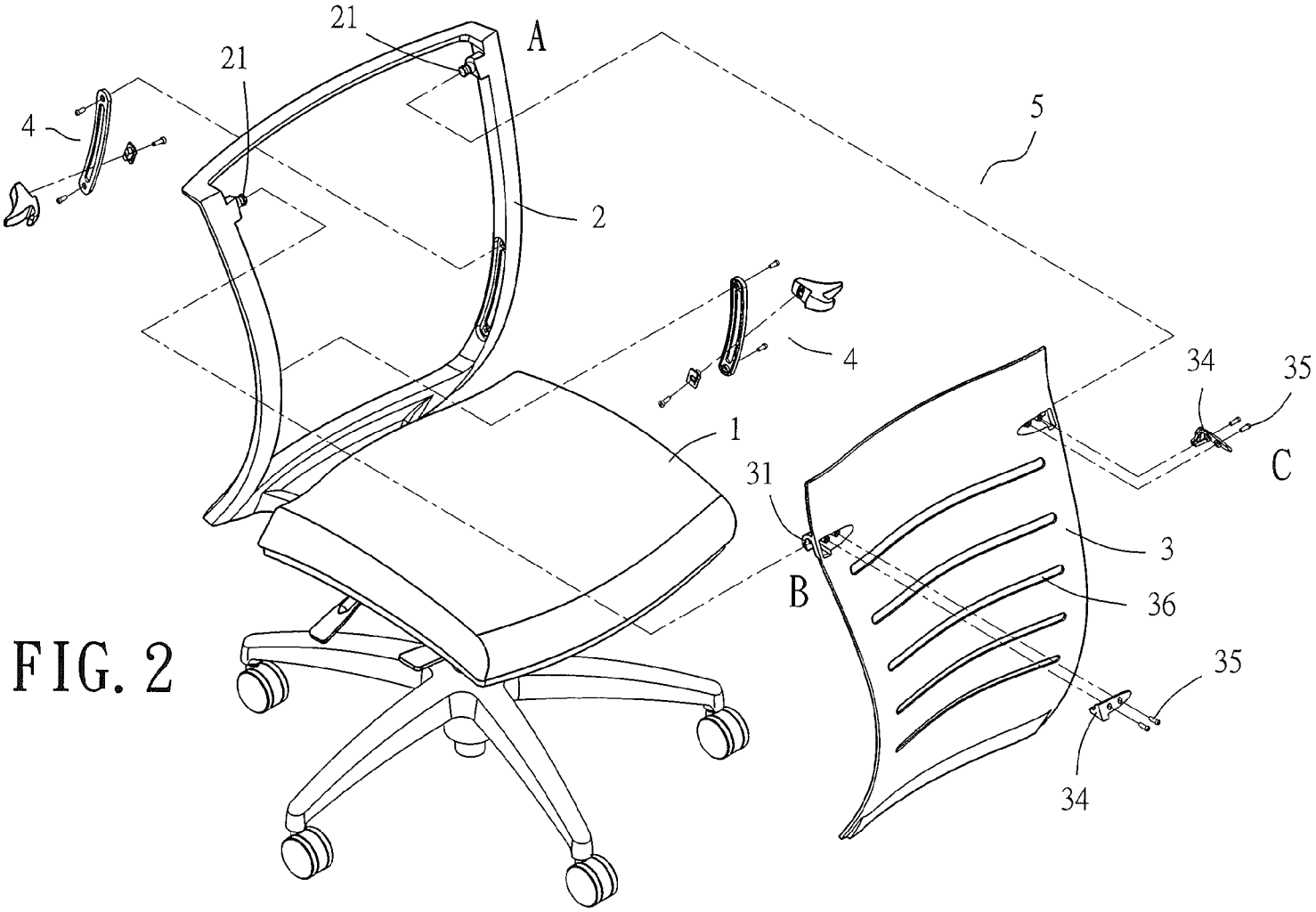
FIG. 2 is an exploded perspective view of the chair backrest panel positioning device of the present invention.

The present invention provides a chair backrest panel positioning device to enhance the comfort of one who leans their back on the backrest of a chair. Referring to FIG. 2, the chair backrest panel positioning device includes a backrest panel frame 2 and a backrest panel 3. The backrest panel frame 2 has a hollow configuration, is formed along the rear side of the seat 1 of a chair 5, and has two upper lateral portions for retaining predetermined portions of the backrest panel 3 respectively. The backrest panel 3 is separately formed, may or may not conform in shape to the backrest panel frame 2, and has proper elasticity. The backrest panel frame 2 also has two lateral portions which are at a predetermined height and allow movement-limiting units 4 to clamp the corresponding areas of the backrest panel 3 respectively. The mechanism by which the backrest panel 3 is bilaterally clamped at the predetermined height of the backrest panel frame 2 is not a technical feature.

Figure 2C:
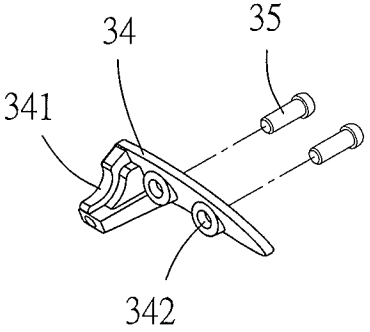
FIG. 2C is an enlarged view of the portion C in FIG. 2.
Figure 2B:
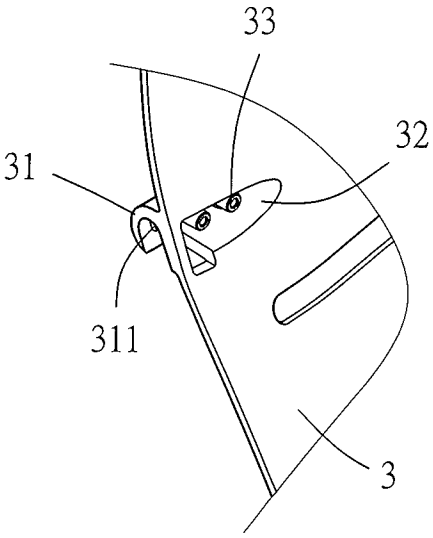
FIG. 2B is an enlarged view of the portion B in FIG. 2.
Figure 2A:
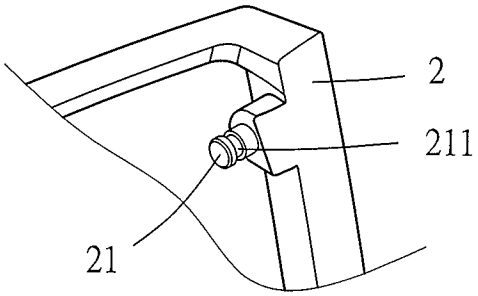
FIG. 2A is an enlarged view of the portion A in FIG. 2.
Figure 3:
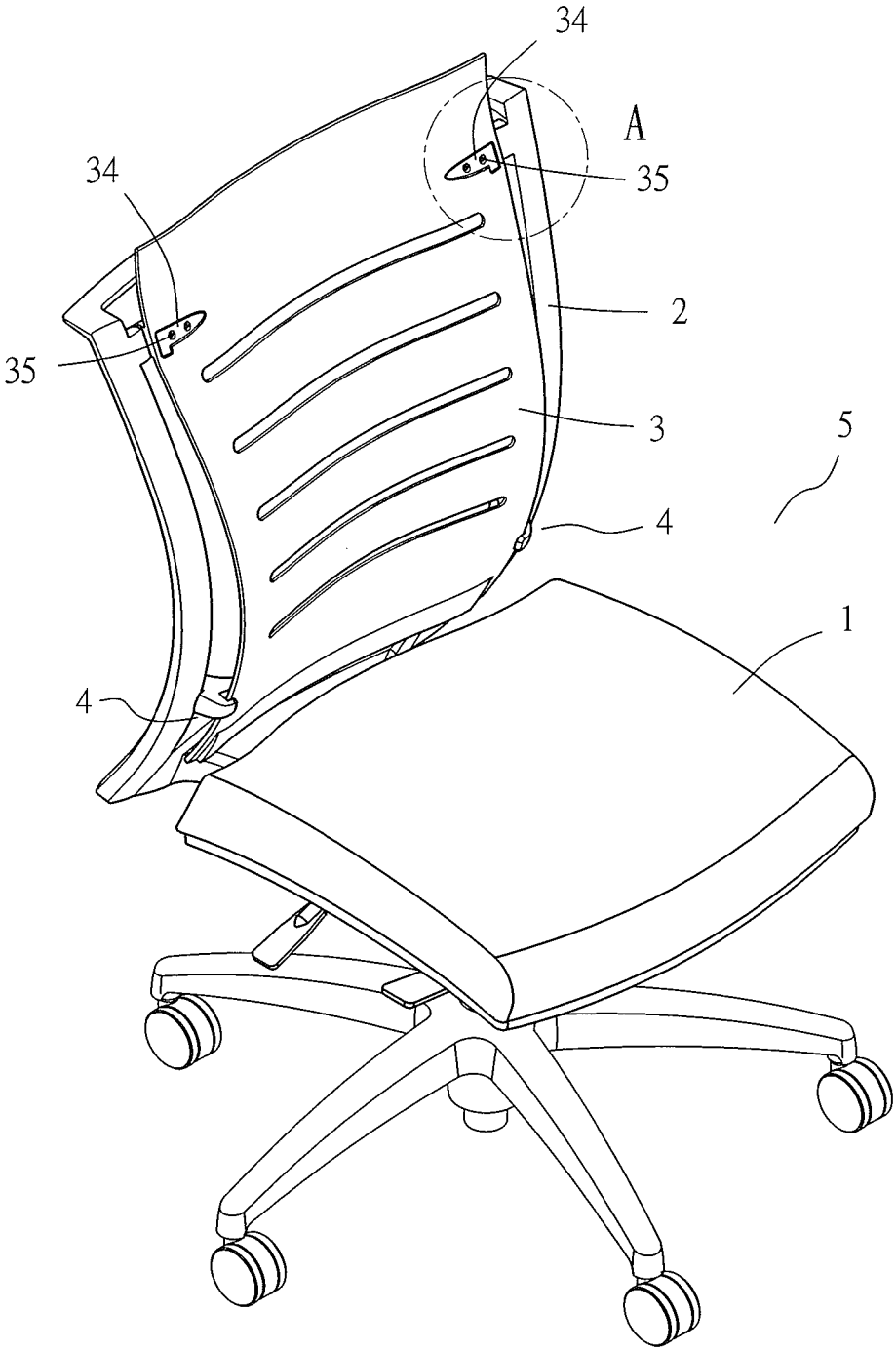
FIG. 3 is an assembled perspective view of the chair backrest panel positioning device in FIG. 2.
Figure 3A:
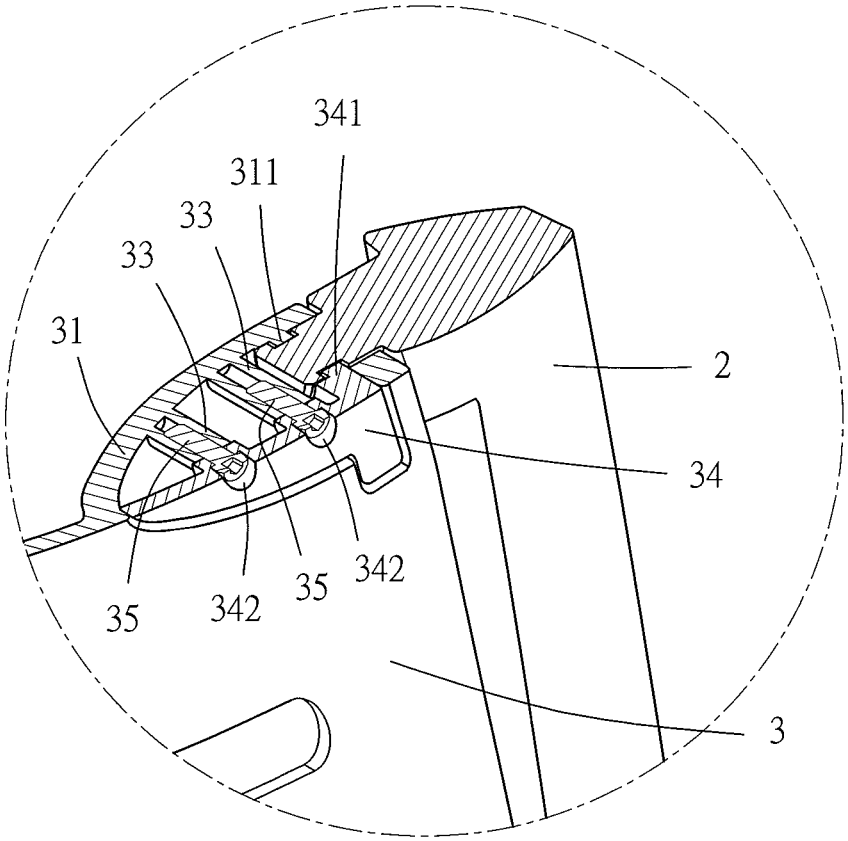
FIG. 3A is a sectional view of the portion A in FIG. 3.

In order for the backrest panel frame 2 to retain the backrest panel 3, the present invention further includes the following technical features: Referring to FIG. 2 and FIG. 2A, each of the two upper lateral portions of the backrest panel frame 2 is extended with a pin 21. The two pins 21 face each other and are each concavely formed with an annular groove 211 at a predetermined section. Two predetermined sections of the rear side of the backrest panel 3 are each formed with a hook 31 which opens downward. The hooks 31 are configured to engage with the pins 21 respectively. The inner side of each hook 31 is protrudingly provided with a curved projection 311 in a predetermined area. Each curved projection 311 is configured to engage with the annular groove 211 of the corresponding pin 21 of the backrest panel frame 2. As shown in FIG. 2B, the front side of the backrest panel 3 has two apertures 32 corresponding in position to and extending from the hooks 31 respectively. At least one tube 33 extends from a predetermined portion of each hook 31, as shown in FIG. 3A. In addition, two limiting members 34 whose shapes conform to those of the apertures 32 respectively are each extended with a pressing flange 341 at one end, as shown in FIG. 2C. Each pressing flange 341 is configured to be inserted through the corresponding aperture 32 of the backrest panel 3 and engaged with the annular groove 211 of the corresponding pin 21 of the backrest panel frame 2, as shown in FIG. 3A. Moreover, a predetermined side of each limiting member 34 is penetrated by at least one hole 342 through which a threaded fastener 35 can be passed in order to be fastened in the corresponding tube 33 of the backrest panel 3. The foregoing technical features enable the two upper lateral portions of the backrest panel frame 2 to respectively and securely retain the predetermined portions of the backrest panel 3, as shown in FIG. 3.

Figure 4:
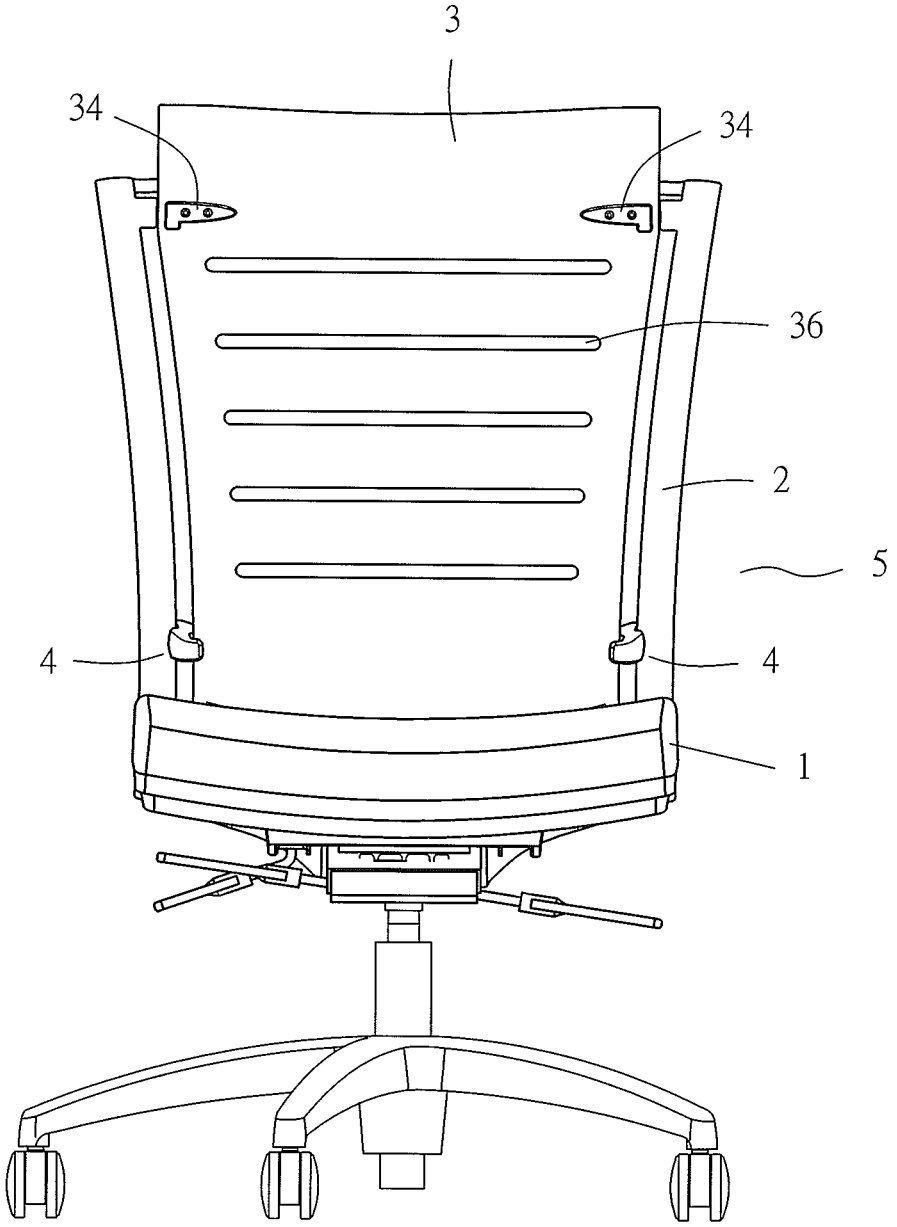
FIG. 4 is a front view of the chair backrest panel positioning device in FIG. 3, with an elastic backrest panel.

Furthermore, referring to FIG. 4, the backrest panel 3, which is to be retained by the backrest panel frame 2, is provided with at least one hollow slot 36 to allow ventilation when leaned on. The at least one hollow slot 36 may or may not be arranged at a predetermined spacing.

Figure 5:
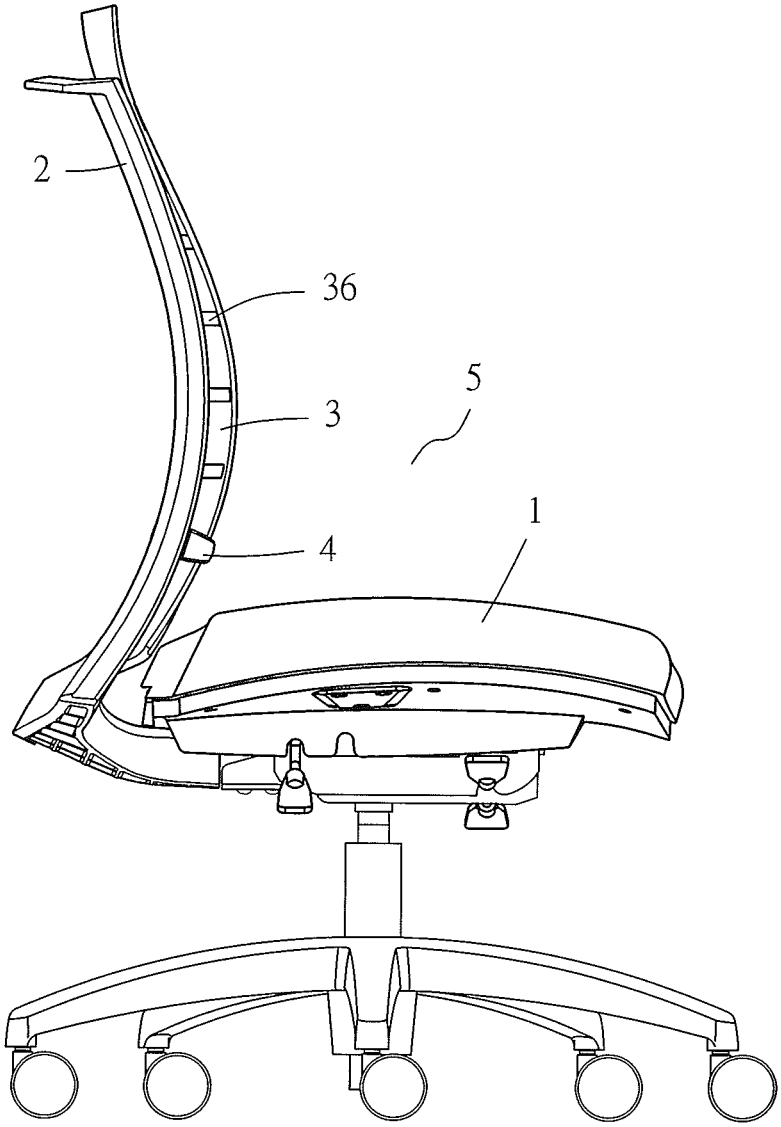
FIG. 5 is a side view of the chair backrest panel positioning device in FIG. 4.

Once the separately formed backrest panel 3 is connected to the two predetermined lateral portions of, and hence mounted to, the backrest panel frame 2 of the chair 5, as shown in FIG. 5, a user can sit on the chair 5 and lean his or her back elastically against the backrest panel 3 on the backrest panel frame 2.

What is claimed is:

1. A chair backrest panel positioning device, configured to enable a backrest of a chair to be leaned on comfortably, with the chair backrest panel positioning device comprising a backrest panel frame and a backrest panel, wherein the backrest panel frame has a hollow configuration, is formed along a rear side of a seat of the chair, and has two upper lateral portions configured for retaining predetermined portions of the backrest panel respectively; wherein the backrest panel is separately formed and has elasticity; wherein the backrest panel frame further has two lateral portions which are at a predetermined height and are configured for clamping corresponding areas of the backrest panel respectively, wherein in order for the backrest panel frame to retain the backrest panel, the two upper lateral portions of the backrest panel frame are each extended with a pin, wherein the pins of the two upper lateral portions face each other and each is concavely formed with an annular groove, wherein the backrest panel has a rear side with two predetermined sections each formed with a hook, wherein the hooks of the two predetermined sections open downward and are engaged with the pins of the two upper lateral portions respectively, wherein each said hook has an inner side with a predetermined area protrudingly provided with a curved projection engaged with the annular groove of a corresponding one of the pins of the two upper lateral portions, wherein the backrest panel has a front side with two apertures corresponding in position to and extending from the hooks of the two predetermined sections respectively, wherein each said hook has a predetermined portion extended with a tube, wherein two limiting members conform in shape to the two apertures respectively and each have an end extended with a pressing flange, wherein each said pressing flange is inserted through a corresponding one of the two apertures of the backrest panel and is engaged with the annular groove of the corresponding one of the pins of the two upper lateral portions, wherein each said limiting member has a predetermined side penetrated by a hole, wherein a plurality of threaded fasteners is passed through the holes in the predetermined sides of the two limiting members respectively and are fastened in the tubes of the two predetermined sections of the backrest panel respectively, wherein the predetermined portions of the hooks of the two predetermined sections of the backrest panel are securely retained by the two upper lateral portions of the backrest panel frame respectively, and wherein the backrest panel, once mounted to the backrest panel frame, can be leaned on elastically.

2. The chair backrest panel positioning device of claim 1, wherein the backrest panel retained by the backrest panel frame is provided with at least one hollow slot to allow ventilation when the backrest panel is leaned on.

* * * * *